US007734240B2

(12) United States Patent
McNamee et al.

(10) Patent No.: US 7,734,240 B2
(45) Date of Patent: Jun. 8, 2010

(54) FUSERS, PRINTING APPARATUSES AND METHODS, AND METHODS OF FUSING TONER ON MEDIA

(75) Inventors: Brian J. McNamee, Brockport, NY (US); David P. Van Bortel, Victor, NY (US); Brendan H. Williamson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 46 days.

(21) Appl. No.: 12/266,940

(22) Filed: Nov. 7, 2008

(65) Prior Publication Data

US 2010/0119267 A1 May 13, 2010

(51) Int. Cl.
*G03G 15/20* (2006.01)

(52) U.S. Cl. ..... 399/328; 399/330; 399/333

(58) Field of Classification Search ..... 399/320, 399/322, 323, 328, 329, 330, 333
See application file for complete search history.

(56) References Cited

U.S. PATENT DOCUMENTS 6,567,641 B1 * 5/2003 Aslam et al. ..... 399/330
7,603,068 B2 * 10/2009 Tsueda et al. ..... 399/328
2008/0037069 A1 2/2008 Mestha et al.

OTHER PUBLICATIONS

U.S. Appl. No. 12/197,492, filed Aug. 25, 2008.

* cited by examiner

*Primary Examiner*—Hoang Ngo
(74) *Attorney, Agent, or Firm*—Edward A. Brown; Prass LLP

(57) ABSTRACT

Fusers, printing apparatuses and methods, methods of fusing toner on media are disclosed. An embodiment of the fusers for fusing toner on a medium includes a rotatable fuser member including an outer fusing surface; a first indenter adapted to form a first indentation in the fusing surface at a first location during movement of the fuser member relative to the first indenter; and a second indenter adapted to form a second indentation in the fusing surface at a second location laterally spaced from the first location during movement of the fuser member relative to the second indenter.

26 Claims, 9 Drawing Sheets

FUSERS, PRINTING APPARATUSES AND METHODS, AND METHODS OF FUSING TONER ON MEDIA

BACKGROUND

Fusers, printing apparatuses and methods, and methods of forming images on media are disclosed. In some printing apparatuses, toner images are formed on media and the media are then heated to fuse (fix) the toner onto the media. Such printing apparatuses can include a fuser member, and a pressure roll, which define a nip between them. Media are fed to the nip where the fuser member and pressure roll heat and apply pressure to the media to fuser the toner.

Images can also be formed on media using ink jet printers, and other types of printing apparatuses.

It would be desirable to provide apparatuses and methods for forming images on media with improved apparatus life and image quality.

SUMMARY

Embodiments of fusers, printing apparatuses and methods, methods of forming images on media are disclosed. An embodiment of the fusers for fusing toner on a medium comprises a rotatable fuser member including an outer fusing surface; a first indenter adapted to form a first indentation in the fusing surface at a first location during movement of the fuser member relative to the first indenter; and a second indenter adapted to form a second indentation in the fusing surface at a second location laterally spaced from the first location during movement of the fuser member relative to the second indenter.

DRAWINGS

DETAILED DESCRIPTION

The disclosed embodiments include a fuser for fusing toner on a medium, which comprises a rotatable fuser member including an outer fusing surface; a first indenter adapted to form a first indentation in the fusing surface at a first location during movement of the fuser member relative to the first indenter; and a second indenter adapted to form a second indentation in the fusing surface at a second location laterally spaced from the first location during movement of the fuser member relative to the second indenter.

The disclosed embodiments further include a printing apparatus, which comprises a first roll including a first outer surface; a second roll including a second outer surface, a longitudinal axis and a length dimension along the longitudinal axis; a nip between the first and second outer surfaces; a first indenter adapted to form a first indentation at a first location in the second outer surface; and a second indenter adapted to form a second indentation in the second outer surface at a second location laterally spaced from the first location along the length dimension.

The disclosed embodiments further include a method of printing using a printing apparatus comprising a first roll including a first outer surface, a second roll including a second outer surface, a longitudinal axis and a length dimension along the longitudinal axis, and a nip between the first and second outer surfaces. The method comprises forming a first indentation at a first location in the second outer surface with a first indenter during rotation of the second roll; forming a second indentation at a second location in the second outer surface, which is laterally spaced from the first location along the length dimension, with a second indenter during rotation of the second roll; and feeding the medium to the nip where the medium contacts the first and second outer surfaces and the first and second indentations overlap opposed first and second edges, respectively, of the medium.

Figure 1:
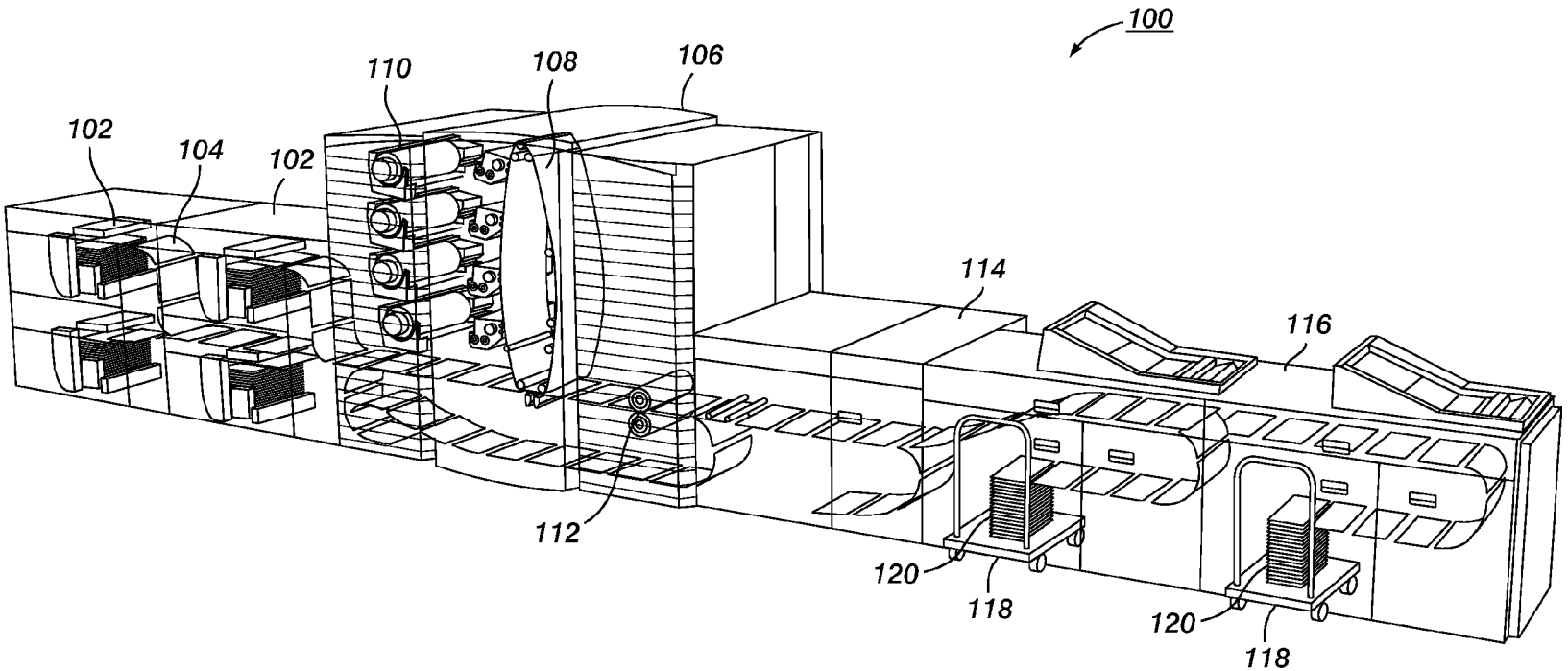
FIG. 1 illustrates an exemplary embodiment of a printing apparatus.

FIG. 1 illustrates an exemplary printing apparatus 100, such as disclosed in U.S. Patent Application Publication No. 2008/0037069, which is incorporated herein by reference in its entirety. As used herein, the term "printing apparatus" encompasses any apparatus, such as a digital copier, bookmaking machine, multifunction machine, and the like, that performs a print outputting function for any purpose. In the illustrated embodiment, the printing apparatus 100 has a modular construction. As shown, the printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 feed media to the printer module 106. In the printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 adapted to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
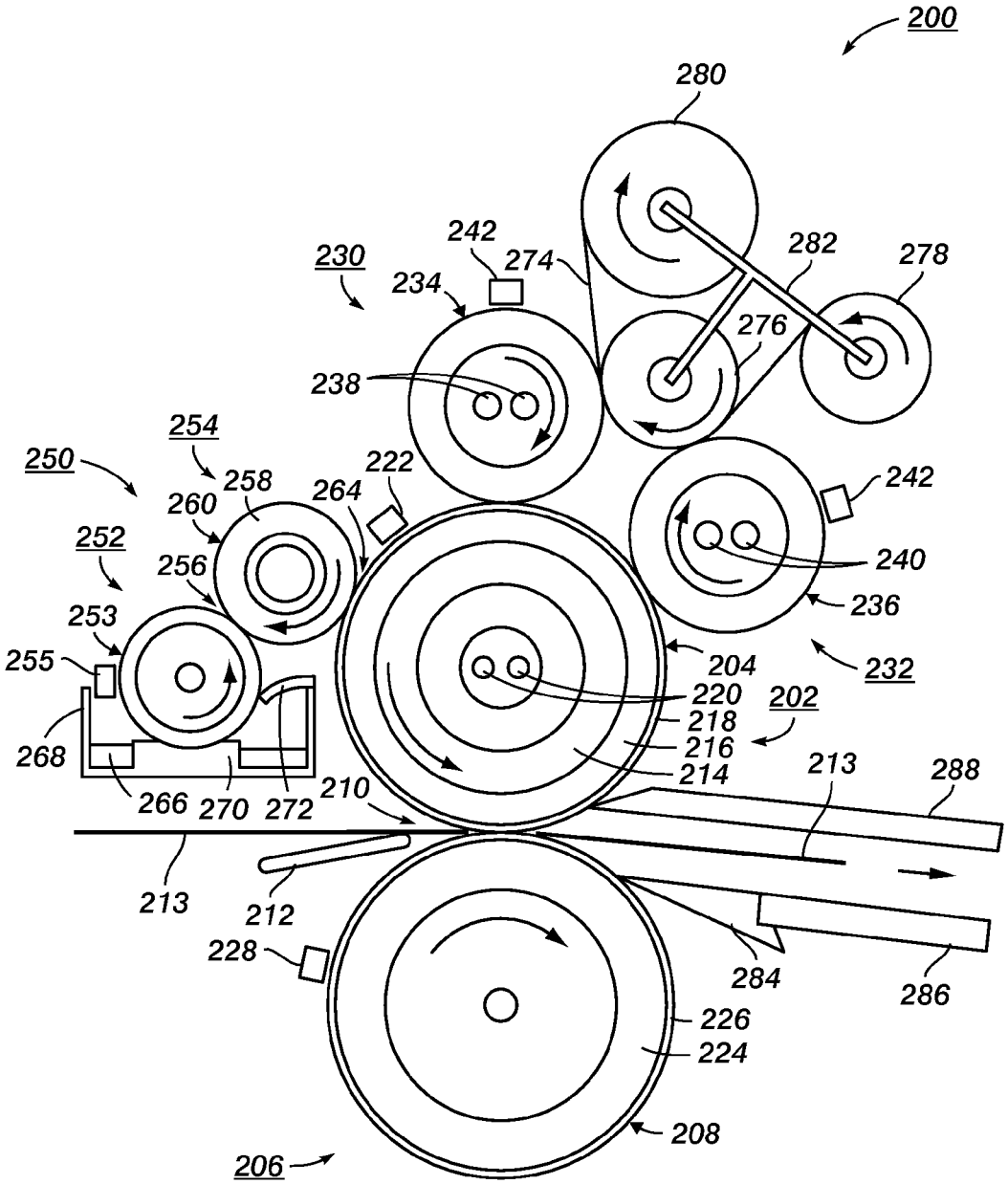
FIG. 2 illustrates an exemplary embodiment of a fuser including a fuser roll and a pressure roll.

FIG. 2 illustrates an exemplary embodiment of a fuser 200. The fuser 200 includes a fuser member, which is a fuser roll 202 having a fusing surface 204, and a pressure roll 206 having an outer surface 208. A nip 210 is formed between the fusing surface 204 and the outer surface 208. In embodiments, the fuser roll 202 is driven by a drive mechanism and the pressure roll 206 is connected to a cam. The fuser roll 202 and pressure roll 206 rotate in opposite directions, as shown. A guide 212 is positioned to direct media carrying toner images into the nip 210 where the fuser roll 202 and pressure roll 206 apply sufficient heat and pressure to the media and toner to fuse the toner images onto the media.

The fuser roll 202 includes a core 214, an inner layer 216 overlying the core 214, and an outer layer 218 overlying the inner layer 216. In embodiments, the core 214 is comprised of a metal, and the inner layer 216 and outer layer 218 are comprised of elastomeric materials. The outer layer 218 includes the fusing surface 204.

Heating elements 220 are located inside the core 214. A thermistor 222 is shown positioned adjacent the fusing surface 204.

The pressure roll 206 includes a core 224, and an outer layer 226 overlying the core 224. In embodiments, the core 224 is comprised of a metal, and the outer layer 226 is comprised of an elastomeric material. A thermistor 228 is shown positioned adjacent the outer surface 208.

The fuser 200 includes external heating rolls 230, 232 having respective outer surfaces 234, 236. The heating rolls 230, 232 can be comprised, e.g., of anodized aluminum. As shown, the heating rolls 230, 232 rotate in the same direction. In embodiments, the heating rolls 230, 232 are connected to cams and have fixed centers. The outer surfaces 234, 236 contact the fusing surface 204 of the fuser roll 202. Heating elements 238, 240 are located inside of the heating rolls 230, 232, respectively. A thermistor 242 is shown positioned adjacent each outer surface 234, 236. The heating rolls 230, 232 heat the fusing surface 204.

A liquid supply system 250 is positioned to supply a liquid release agent to the fusing surface 204 of the fuser roll 202, to promote release of toner and media from the fusing surface 204. The liquid supply system 250 includes a metering roll 252 and a donor roll 254 defining a nip 256. The metering roll 252 includes an outer surface 253. A thermistor 255 is positioned adjacent the outer surface 253. The donor roll 254 includes an inner layer 258, and an outer layer having an outer surface 260 on the inner layer 258. The inner layer 258 and outer layer can be comprised of elastomeric materials. The donor roll 254 and the fusing surface 204 define a nip 264.

The metering roll 252 contacts a liquid release agent 266 contained in a sump 268. A wick 270 is provided in the sump 268. The metering roll 252 and donor roll 254 convey the release agent 266 from the sump 268 to the metering roll 252, from the metering roll 252 to the donor roll 254 at nip 256, and from the donor roll 254 to the fusing surface 204 at nip 264. A metering blade 272 contacts with the outer surface 253 of the metering roll 252 to meter the release agent to the donor roll 254.

The fuser 200 further includes a cleaning web 274 supported on a web nip roll 276. The web nip roll 276 is connected to a web supply roll 278 and a web take-up roll 280 by a frame 282. The cleaning web 274 is unwound from the web supply roll 278 and taken-up on the driven web take-up roll 280 as these rolls rotate, as shown. The cleaning web 274 cleans the outer surfaces of the heating rolls 234, 236.

As shown, the fuser 200 further includes a stripper finger 284, baffle 286, and an air knife 288.

Figure 3:
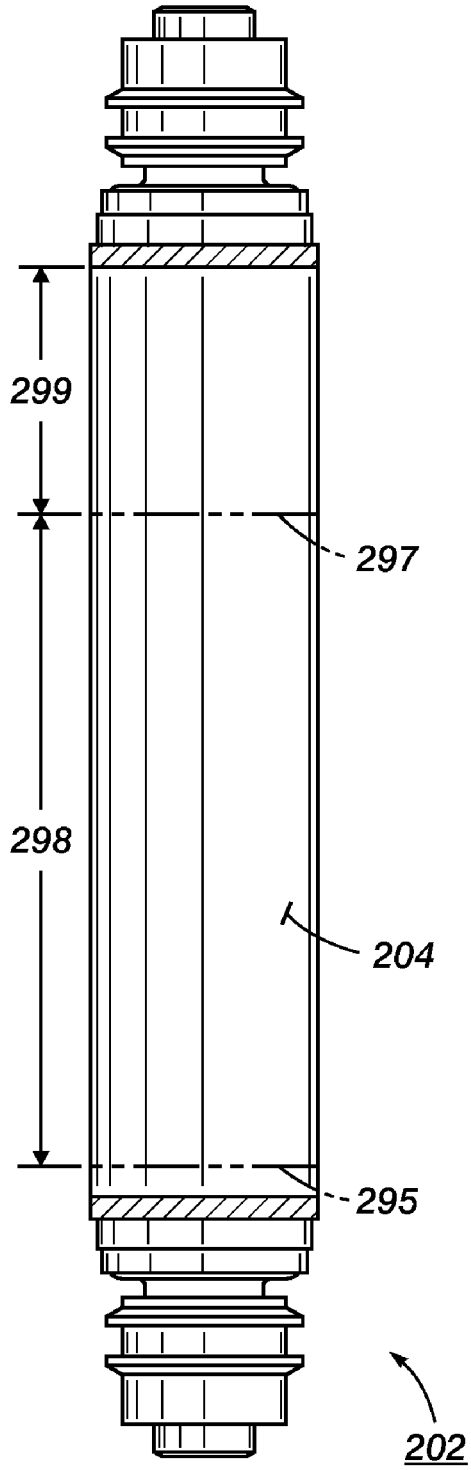
FIG. 3 illustrates an exemplary embodiment of the fuser roll of the fuser of FIG. 2.

FIG. 3 shows an exemplary embodiment of the fuser roll 202 of the fuser 200 shown in FIG. 2. The locations of a media registration edge 295, an outer edge 297, an inside media path length 298, and an outside media path length 299 are indicated in FIG. 3. The inside media path length 298 corresponds to the width of a medium having an inner edge registered at the media registration edge 295 and an outer edge positioned at outer edge 297. The outside media path of the fusing surface 204 lies outward from the outer edge 297 and is not contacted by media that are registered at the media registration edge 295 and have a width corresponding to the inside media path length 298. For media registered at the media registration edge 295, the location of the outer edge 297 will vary for different media widths.

When a medium 213 (FIG. 2) is fed through the nip 210 of the fuser 200, the pressure roll 206 applies pressure to the fuser roll 202. When an inner edge of the medium 213 is registered at the media registration edge 295, pressure acts at the inner edge of the medium 213 positioned at the media registration edge 295 and at the outer edge of the medium 213 positioned at the outer edge 297 of the inside media path length 298. This pressure produces mechanical strain on the outer layer 218 of the fuser roll 202. Consequently, the outer layer 218 can be abraded at the locations of the paper registration edge 295 and/or outer edge 297 where the opposed edges of the medium 213 contact the fusing surface 204 of the fuser roll 202. This abrasion can produce edge wear in the fusing surface 204 at these locations. Edge wear causes gloss differentials in fused toner images when such surface defects in the fusing surface 204 are printed onto media.

Figure 4:
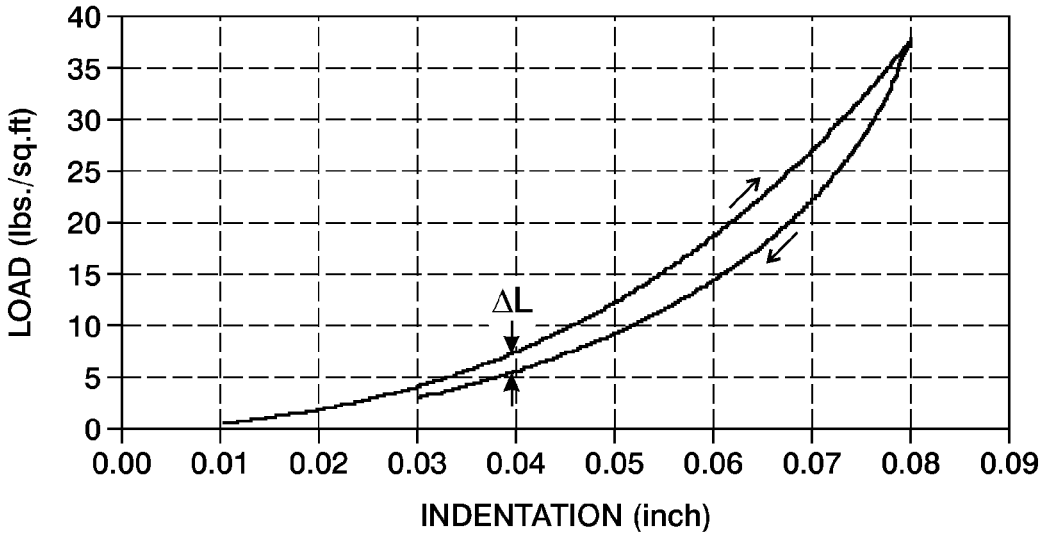
FIG. 4 shows an exemplary applied load versus indentation depth curve for indenting an outer portion of a fuser roll.

FIG. 4 shows an exemplary curve of applied load versus indentation depth for loading a fuser roll including a metallic core, an inner layer comprised of silicone on the core, and an outer layer comprised of a fluoroelastomer sold under the trademark Viton® by DuPont Performance Elastomers, L.L.C., on the inner layer. The fuser roll is loaded using an indenter. As shown, the indentation depth produced by the applied load as the load is increased is larger than the indentation depth produced by the load as the load is decreased. For example, at an indentation depth of 0.4 inch, the loads vary by about 25%. As the load is decreased, the deformed material will eventually recover to the pre-loaded condition.

Figure 5:
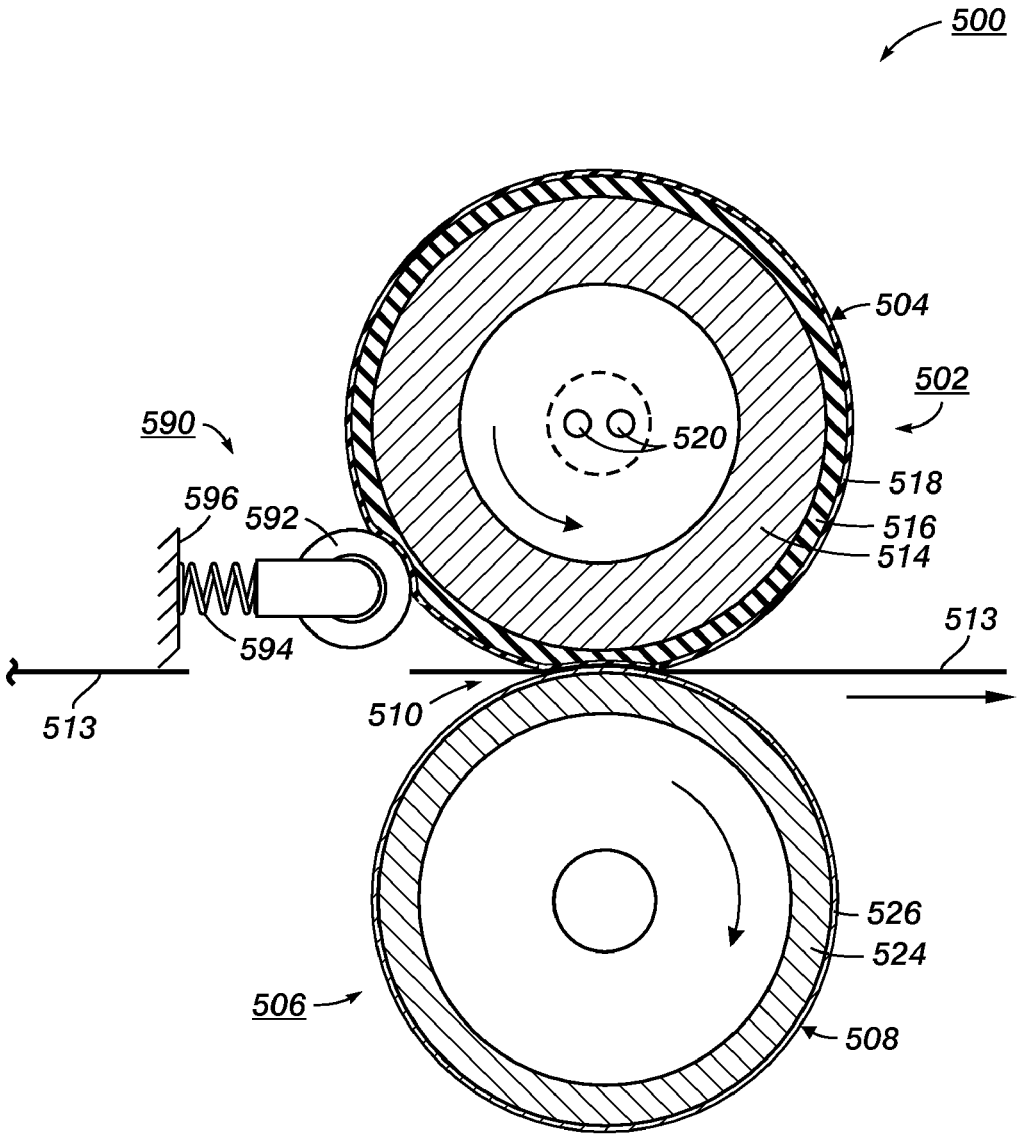
FIG. 5 is a partial cross-sectional view of an exemplary embodiment of a fuser including a fuser roll and an indentation device for forming indentations in the fuser roll.

FIG. 5 depicts a fuser 500 according to an exemplary embodiment. The fuser 500 is constructed to fuse toner on media with reduced edge wear of the fuser member. Embodiments of the fuser 500 can be used in different printing apparatuses. For example, the fuser 500 can be used in the printing apparatus 100 shown in FIG. 1 in place of the fuser 112. The fuser 500 is adapted to fuse toner on various types of media, including, e.g., coated or uncoated (plain) paper sheets, transparencies, and packaging materials. The media can have varying sizes and weights ranging from light-weight to heavy-weight.

Embodiments of the fusers include a fuser member. In the illustrated embodiment of fuser 500, the fuser member is a fuser roll 502. The fuser 500 further includes a pressure roll 506. As indicated in FIG. 5, the fuser roll 502 and pressure roll 506 rotate about respective axes in opposite directions to transport a medium 513 (e.g., coated paper or un-coated paper) through a nip 510 formed by the fuser roll 502 and pressure roll 506. Another medium 513 is shown approaching the nip 510.

In embodiments, the fuser roll 502 includes a core 514, an inner layer 516 on the core 514, and an outer layer 518 on the inner layer 516. In an exemplary embodiment, the core 514 is comprised of aluminum, or the like; the inner layer 516 is comprised of an elastomeric material, such as silicone, or the like; and the outer layer 518 is comprised of an elastomeric material, such as Viton®, or the like. The outer layer 518 includes the fusing surface 504. Typically, the inner layer 516 can have a thickness of about 2 mm to about 10 mm, and the outer layer 518 can have a thickness of about 10 μm to about 50 μm.

In embodiments, the pressure roll 506 includes a core 524, and an outer layer 526 on the core 524. In an exemplary embodiment, the core 524 is comprised of aluminum, or the like, and the outer layer 526 is comprised of a deformable thermoplastic material, such as perfluoroalkoxy (PFA) copolymer resin, or the like.

Embodiments of the fuser 500 further include an indentation device for forming indentations, i.e., recesses, in an outer portion of the fuser roll 502. The outer portion of the fuser roll 502 includes the outer layer 518. The outer portion can also include one or more layers underlying the outer layer 518. The underlying layer(s) can be comprised of the same deformable material, or a different deformable material, as the outer layer 518.

In the illustrated embodiment of fuser 500, an indentation device 590 is positioned counter-clockwise from the nip 510 about the outer circumference of the fuser roll 502 as defined by the fusing surface 504. In embodiments, the indentation device 590 can be located within about one-quarter of the outer circumference (i.e., about 90°) of the nip 510 when the fuser roll 502 rotates counter-clockwise.

In embodiments, the indentation device 590 includes at least two indenters. Each indenter is adapted to form an indentation in the fusing surface 504 of the fuser roll 502. In embodiments, the indenters can perform a rolling movement on the fusing surface 504. For example, the indenters can be rolls (e.g., wheels), spherical bodies, or the like. Indenters that do not roll on the fusing surface 504 can also be used in embodiments. Embodiments of the indenters can form indentations of a desired configuration (shape and size) in the outer portion of the fuser roll. Each indenter can have a low-friction material (e.g., Teflon®, or the like) forming the surface of the indenter that contacts the fusing surface to reduce wear of the fusing surface.

Figure 6:
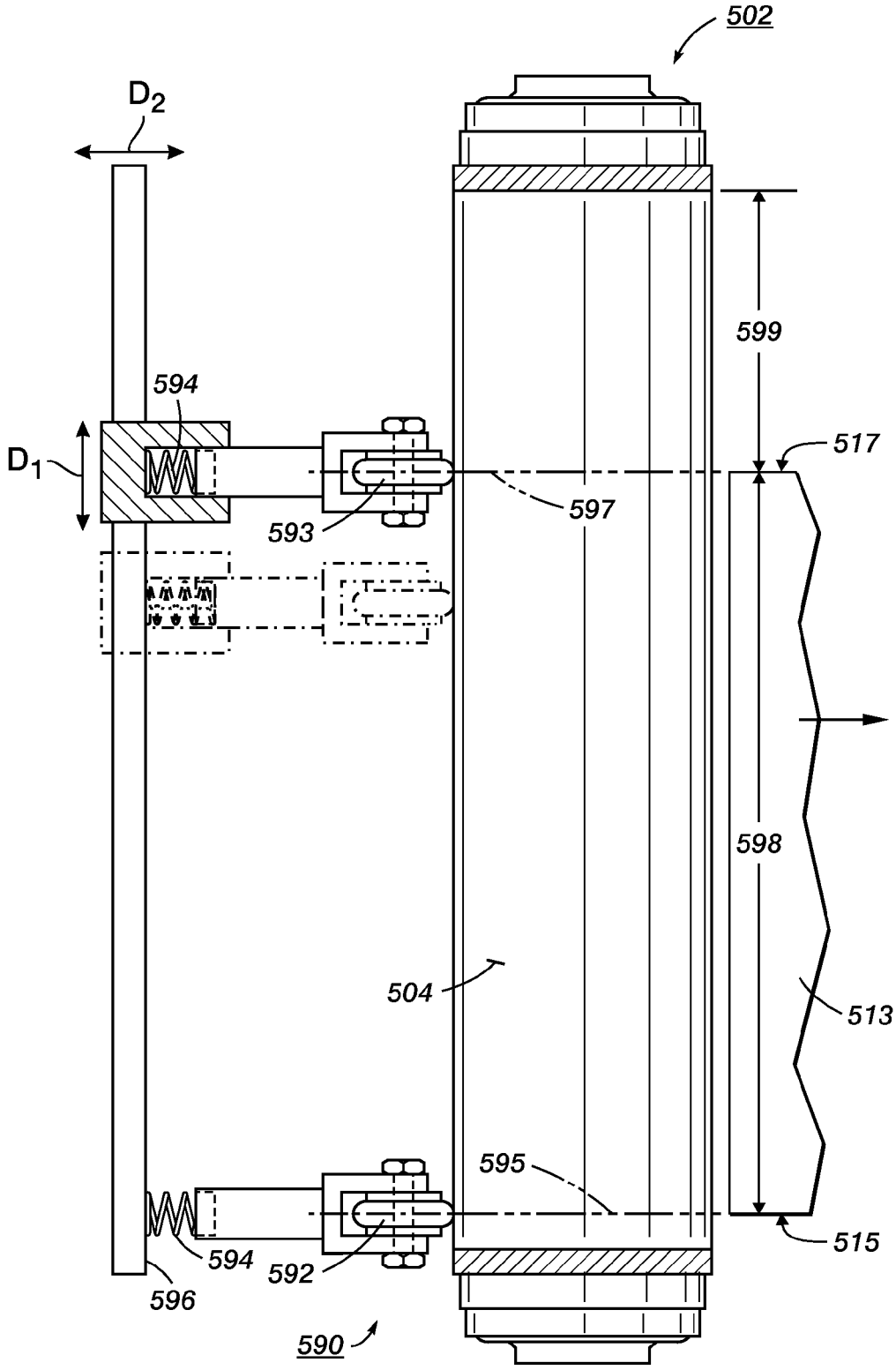
FIG. 6 illustrates an exemplary embodiment of an indentation device including indenters positioned in contact with a fuser roll.

FIG. 6 shows an exemplary embodiment of the indentation device 590. The indentation device 590 includes two indenter rolls 592, 593 provided on a support 596. In this position of the indentation device 590, the indenter rolls 592, 593 are resiliently biased against the fusing surface 504 of fuser roll 502 by springs 594 connected to the support 596 and the indenter rolls 592, 593. The indenter roll 592 is non-movable (fixed) relative to the support 596. The indenter roll 593 is movable with respect to the fusing surface 504 along the length dimension of the fuser roll 502, as depicted by arrow $D_1$, to adjust the location at which the indenter roll 593 contacts the fusing surface 504. An adjusted position of the indenter 593 is depicted in phantom line in FIG. 6.

FIG. 6 shows a medium 513 being transported in the process direction in the fuser. The medium 513 has an inner edge 515 and an outer edge 517. As shown, the medium 513 can be, e.g., inboard registered with respect to the fusing surface 504, with the inner edge 515 aligned with the media registration edge 595, and the outer edge 517 aligned with the outer edge 597. The locations of the indenter rolls 592, 593 with respect to the inner edge 515 and outer edge 517 of medium 513 are also shown.

In other embodiments of the fusers, the indentation device can include at least two movable indenters. For example, the indentation device can include two or more movable indenter rolls movably supported on a support. In such embodiments, when, e.g., a medium is inboard registered, center registered, or outboard registered, with respect to the fusing surface 504 of the fuser roll 502, the positions of both indenter rolls can be adjusted along the length of the fuser roll 502 to desired locations with respect to the opposed edges of media that define their width.

In embodiments, both indenter rolls 592, 593 of the indentation device 590 can be movable into contact, and away from contact, with the fuser roll 502, in a direction, $D_2$. For example, the indenter rolls 592, 593 can be moved away from contact with the fuser roll 502 during warm-up of the fuser 500, idling of the printing apparatus, or servicing of the printing apparatus, and then moved back into contact with the fuser roll 502 when a print job is to be performed with the fuser. In such embodiments, any suitable device can be connected to the support 596 to move the indenter rolls 592, 593 into and out of contact with the fuser roll 502.

In embodiments, the indenter rolls 592, 593 are comprised of a material that is harder than the material(s) of the outer layer 518 and inner layer 516 of the fuser roll 502. For example, the indenter rolls 592, 593 can be comprised of a metal, such as steel or aluminum; a ceramic material; a hard polymeric material, or the like. As shown in FIG. 6, the surfaces of the indenter rolls 592, 593 in contact with the fusing surface 504 can have a curved shape to form indentations with curved surfaces in the fuser roll 502. In other embodiments, the contact surfaces of the indenter rolls 592, 593 can have other shapes, such as planar. The indenter rolls 592, 593 are adapted to apply pressure at two axially-spaced (laterally-spaced) locations on the fusing surface 504. The applied pressure is sufficiently-high to form two axially-spaced indentations in the outer portion of the fuser roll 502 as the fuser roll 502 is rotated. The outer portion of the fuser roll 502 in which the indentations are formed includes at least the outer layer 518. The two indentations extend circumferentially on the fusing surface 504 (e.g., along the directions of the media registration edge 595 and outer edge 597 shown in FIG. 6). The indentations are typically parallel to each other.

In embodiments, the springs 594 exert a sufficiently-high spring force to cause the indenter rolls 592, 593 to form the indentations in the outer portion of the fuser roll 502. The force exerted by the springs 594 can be selected, and/or adjusted, to control the as-formed depth of the indentations.

In embodiments, the indentations are formed by the indenter rolls 592, 593 in the fusing surface 504 at respective locations effective to overlap respective opposite edges of media that contact the fusing surface 504 and the pressure roll 506 at the nip 510. As shown in FIG. 6, the indenter rolls 592, 593 can be positioned to form indentations in the fusing surface 504 at a first location overlapping the inner edge 515 of medium 513, and at a second, axially-spaced location overlapping the outer edge 517 of medium 513. The indentations can typically be spaced from each other by a distance of about 7 inch to about 14 inch for fusing different media, e.g., paper, widths.

In embodiments, the indentations formed by the indenters in the outer portion of the fuser roll 502 including the fusing surface 504 can have a depth greater than the thickness of the outer layer 518 and extend partially into the inner layer 516. That is, the indentations can extend to a depth below the outer layer 518/inner layer 516 interface. The indentations typically can have a depth of, e.g., about 1 mm to about 2 mm below the fusing surface 504.

Figure 7:
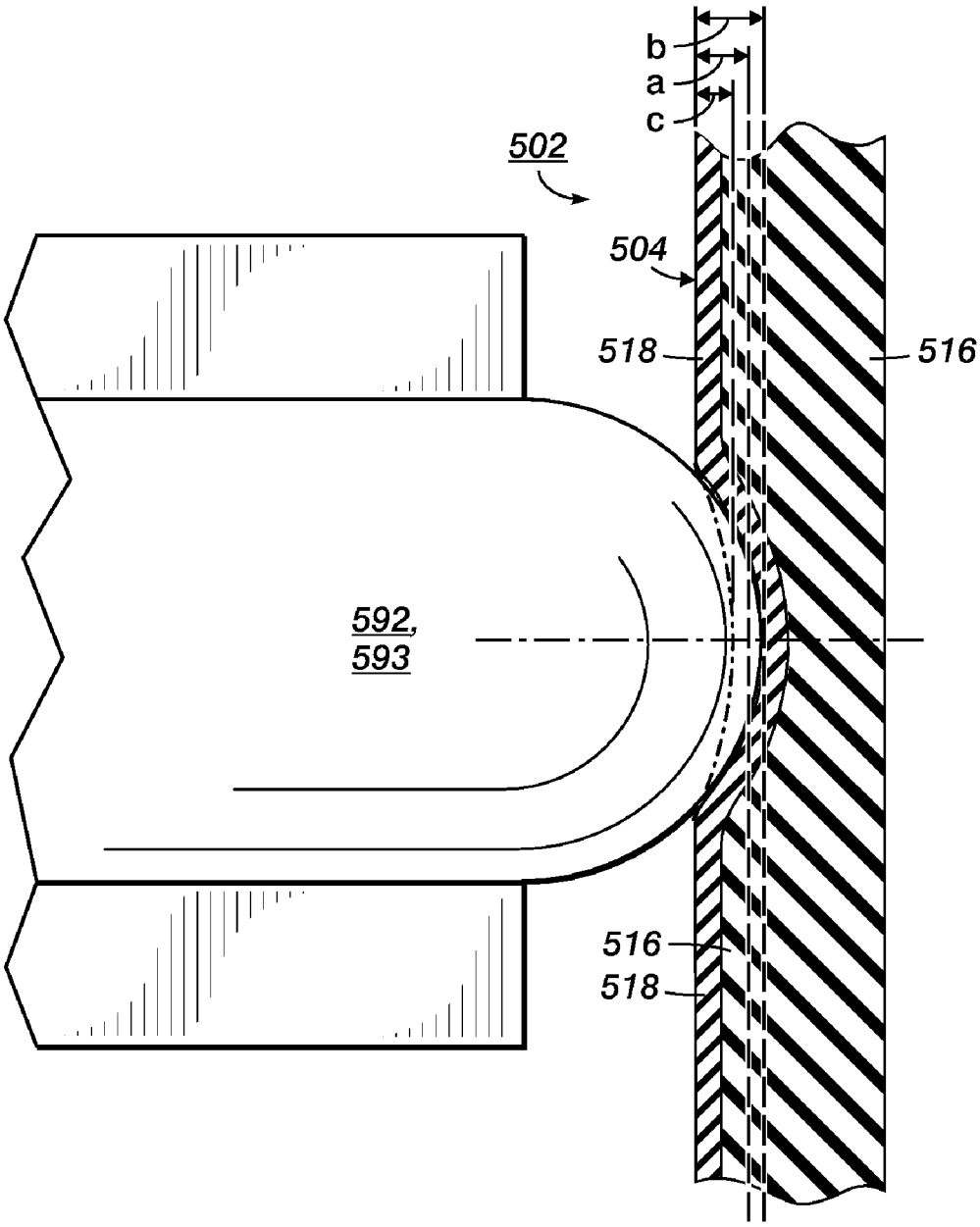
FIG. 7 is a longitudinal cross-sectional view showing an exemplary indentation formed in an outer portion of a fuser roll by an indenter.

In embodiments, the materials used to form the outer layer 518 and the inner layer 516 of the fuser roll 502 have a relatively slow rebound rate after these materials have been compressed by the indenter rolls 592, 593, such as shown in the curve in FIG. 4. FIG. 7 shows a typical configuration of an indentation formed in the fuser roll 502 by applying an indenting force with one of the indenter rolls 592, 593. For simplicity, only the outer layer 518 and the inner layer 516 of the fuser roll 502 are shown in FIG. 7. As shown, the indentation extends to a depth, b, below the fusing surface 504. The depth, b, is greater than the thickness of the outer layer 518, such that the indentation extends into the inner layer 516. The depth, b, can be varied depending, e.g., on the thickness and/or roughness of media fused at the nip 505. For example, the depth, b, can be increased by increasing the load applied to the fusing surface 504 by the indenter rolls 592, 593 to fuse thicker media and/or rougher media. In embodiments, a substantially constant indentation depth, b, can be formed when the same type of media is fused using the fuser. In embodiments, the indentations formed by the indenters can have about the same depth, b.

For comparison, FIG. 7 also shows a depth, a, corresponding to the deformation depth of the fuser roll 502 produced by the outer layer 518 and inner layer 516 being compressed by pressure applied between the pressure roll 506 and fuser roll 502 at the nip 510. The depth, a, can be about 0.75 mm, for example. As shown, the indentation depth, b, produced by the indenter rolls 592, 593 exceeds the deformation depth, a.

The indentations formed in the fuser roll 502 by the indentation device 590 rotate through the nip with media being fused. After the indentations are formed in the fuser roll 502, the indentations begin to relax. FIG. 7 shows a relaxed indentation depth, c, of the indentation at the nip resulting from the material of at least one of the outer layer 518 and inner layer 516 of the fuser roll 502 having relaxed (elastically recovered) by the time that the indentation reaches the nip 510. As these materials relax, the depth of the indentation decreases from the depth, b, to the depth, c, as the compressed depth is recovered. The relaxed depth, c, can typically be about 15% to about 25% less than the depth, c, depending on the relaxation rates of the materials. The indentation device 590 can be positioned closer to the nip 505 when the materials used to form the outer layer 518 and inner layer 516 have higher relaxation rates to ensure that the indentions formed by the indenter rolls 592, 593 are present at the nip 505. As the fuser roll 502 continues its rotation past the nip 510, the indentations will continue to relax.

Embodiments of the fuser 500 can include at least one external heating roll, such as at least one of the external heating rolls 234, 236 shown in FIG. 2. In such embodiments, the indentation device 590 is positioned between the external heating roll(s) and the nip 510. Heating of the outer portion of the fuser roll using such heating rolls can increase the rate of relaxation of the indentations and enhance smoothing of the fusing surface.

Figure 8:
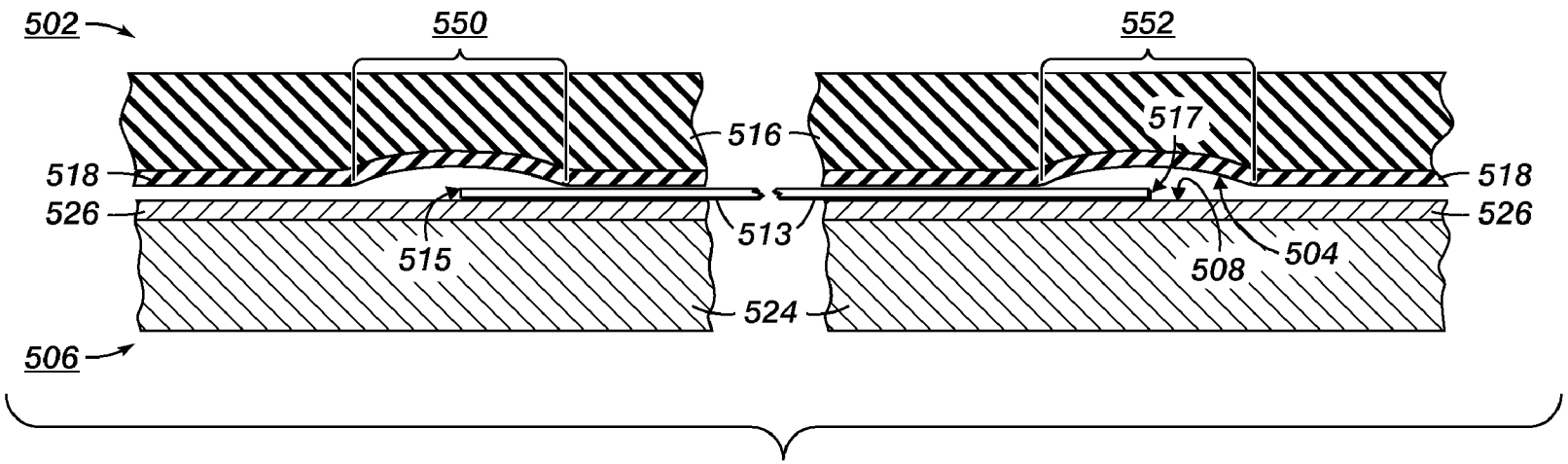
FIG. 8 is a longitudinal cross-sectional view showing a medium positioned between a fuser roll including indentations in an outer portion and a pressure roll at the nip of a fuser.

FIG. 8 depicts medium 513 disposed between the fuser roll 502 and pressure roll 506 at the nip of a fuser. For simplicity, only the outer layer 518 and the inner layer 516 of the fuser roll 502 are shown. Two indentations 550, 552 are shown in the fuser roll 502. The indentations 550, 552 extend below the fusing surface 504 into the inner layer 516. The indentations 550, 552 are formed in the fusing surface 504 at axially-spaced locations along the direction of the longitudinal axis of the fuser roll 502. As shown, the indentation 550 overlaps the inner edge 515 of medium 513, and the indentation 552 overlaps the outer edge 517 of medium 513. In embodiments, the indentations 550, 552 can overlap the respective inner edge 515 and outer edge 517 by a distance in the axial direction of the fuser roll 502 of up to about 3 mm, such as about 2 mm, or about 1 mm. In embodiments, up to the entire width of indentation 550 in the axial direction of the fuser roll 502, and up to the entire width of indentation 552 in the axial direction of fuser roll 502 can overlap the inner edge 515 and outer edge 517, respectively. In embodiments, the indentations 550, 552 can overlap the inner edge 515 and outer edge 517, respectively, by the same distance, or by different distances, in the axial direction of the fuser roll 502.

By forming the indentations 550, 552 at these locations on the fusing surface 504 with respect to the inner edge 515 and outer edge 517 of the medium 513, the amount of pressure exerted by the pressure roll 506 that acts on the inner edge 515 and the outer edge 517 is reduced. This reduction in pressure at the inner edge 515 and outer edge 517 reduces mechanical strain on the outer layer 518 of the fuser roll 502. Consequently, abrasion of the outer layer 518, and edge wear associated with such abrasion, can be reduced by forming the indentations 550, 552 in the fusing roll 502.

Figure 9:
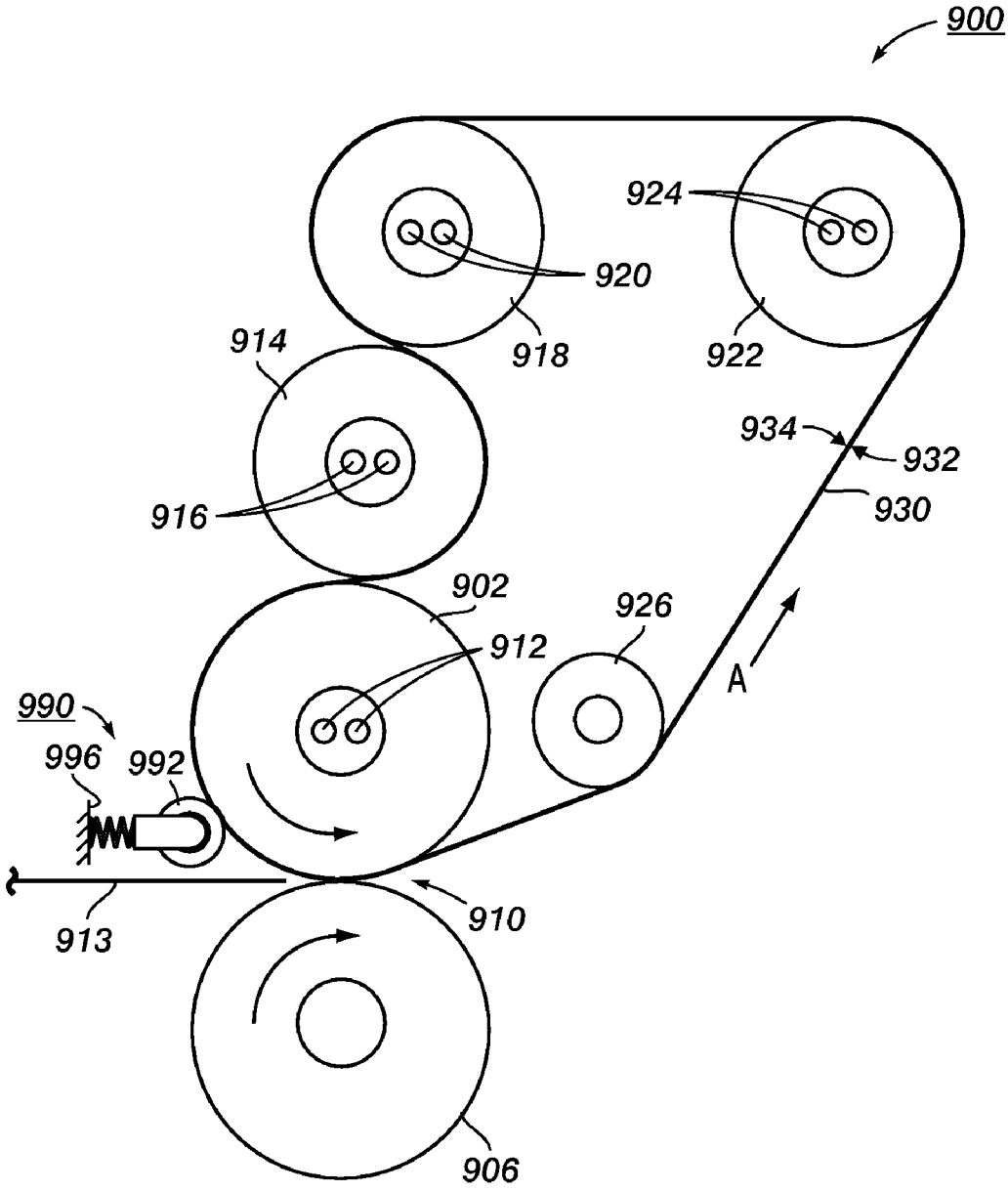
FIG. 9 illustrates another exemplary embodiment of a fuser including a fuser belt and an indentation device for forming indentations in the fuser belt.

FIG. 9 depicts a fuser 900 according to another exemplary embodiment. As shown, the fuser 900 includes a fuser belt 930 supported on a fuser roll 902 and idler rolls 914, 918, 922 and 926. The fuser roll 902 is positioned next to a pressure roll 906. The fuser roll 902 and pressure roll 906 rotate about respective longitudinal axes, and the fuser belt 930 moves counter-clockwise in direction A, as indicated. The fuser belt 930 and the pressure roll 906 define a nip 910. A medium 913 is shown approaching the nip 910. The fuser roll 902 and idler rolls 914, 918, 922 include internal heating elements 912, 916, 920, 924, respectively, to heat the fuser belt 930.

The fuser belt 930 includes an outer, fusing surface 932, which contacts media fed to the nip 910, and an inner surface 934 contacting the supporting rolls. Embodiments of the fuser belt 930 can have a multi-layer construction including, e.g., a base layer, an intermediate layer on the base layer, and an outer layer on the intermediate layer. The base layer forms the inner surface 934, and the outer layer forms the fusing surface 932, of the fuser belt 930. In an exemplary embodiment of the fuser belt 930, the base layer is comprised of a polymeric material, such as polyimide, or the like; the intermediate layer is comprised of silicone, or the like; and the outer layer is comprised of Viton®, Teflon®, or the like.

The fuser 900 further includes an indentation device 990 for forming indentations in an outer portion of the fuser belt 930. The indentation device 990 can have same configuration as the indentation device 590 shown in FIG. 6, for example. Embodiments of the indentation device 990 can include, e.g., a stationary indenter and a movable indenter, or two movable indenters, to allow the indentation device to be used to form indentations on the fusing surface 932 when fusing media that are inboard registered, center registered, or outboard registered, with respect to the fusing surface 932. The outer portion of the fuser belt 930 includes the outer layer forming the fusing surface 932, and can also include one or more layers underlying the outer layer, such as an intermediate layer, depending on the as-formed depth of the indentations.

The indentations are formed in the fusing surface 932 at axially-spaced locations along the width dimension of the fuser belt 930 (along the direction of the longitudinal axis of the fuser roll 902 supporting the fuser belt 902). One indentation can be formed by one of the indenters at a location on the fusing surface 932 to overlap one edge of the medium 913, and another indentation can be formed by another indenter at another location on the fusing surface 932 to overlap an opposite edge of the medium 913. The medium 913 can be inboard registered, center registered, or outboard registered with respect to the fusing surface 932. By forming these indentations with the indenters at these locations on the fusing surface 932, the amount of pressure exerted by the pressure roll 906 that acts on the opposed edges of the medium 913 overlapped by the indentations is reduced. This reduction in pressure at the media edges reduces mechanical strain on the outer layer of the fuser belt 930. Consequently, edge wear can be reduced by forming the indentations in the fuser belt 930.

Embodiments of the indentation devices, such as the indentation device 590 shown in FIG. 6, can also be used in other types of printing apparatuses that include first and second rolls forming a nip. In such printing apparatuses, at least one of the rolls includes an outer portion comprised of an elastomeric material that can be indented with indenters of the indentation device. The indenters can form indentations at axially spaced locations on outer surfaces of such rolls. The indentations can extend parallel to each other about the outer circumferences of such rolls.

For example, the indentation devices can be used in ink jet printing apparatuses that utilize water-based inks or phase-change inks to form images on media. Phase-change inks are solids, which are heated to form a liquid phase. The liquid phase ink is applied to a medium on which the ink solidifies to form images. Such ink jet printing apparatus can include a spreader roll (image-side roll) and a pressure roll, which define a nip. These rolls apply heat and pressure to a printable medium, such as paper. The spreader spreads ink drops applied to the medium. In such ink printing apparatuses, the indentation device can be positioned to form indentations at selected locations in a deformable (e.g., elastomeric) outer portion of the spreader roll to reduce edge wear. The indentations can be formed at axially spaced locations on outer surfaces of such spreader rolls. The indentations can extend parallel to each other about the outer circumferences of such spreader rolls. The indentations can overlap opposed edges of media fed to the nip formed by the spreader roll and pressure roll. For example, embodiments of the indentation devices can be used in ink jet printing apparatuses and spreaders as disclosed in U.S. patent application Ser. No. 12/197,492, filed on Aug. 25, 2008, which is incorporated herein by reference in its entirety.

Embodiments of the indentation devices, such as the indentation device 590 shown in FIG. 6, can also be used in offset printing apparatuses. Such apparatuses include a blanket roll with a deformable (e.g., elastomeric) outer portion. In such offset printing apparatuses, the indentation device can be positioned to form indentations at selected locations in the outer portion of the blanket roll. The indentations can be formed at axially spaced locations on outer surfaces of such blanket rolls. The indentations can extend parallel to each other about the outer circumferences of the blanket rolls.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser for fusing toner on a medium, comprising:

a fuser member including an outer fusing surface;

a first indenter adapted to form a first indentation in the fusing surface at a first location during movement of the fuser member relative to the first indenter; and a second indenter adapted to form a second indentation in the fusing surface at a second location laterally spaced from the first location during movement of the fuser member relative to the second indenter.

2. The fuser of claim 1, wherein:

the first indenter is resiliently biased by a first spring against the fusing surface; and the second indenter is resiliently biased by a second spring against the fusing surface.

3. The fuser of claim 1, wherein:

the first indenter is movable with respect to the fusing surface along a dimension of the fuser member to adjust the first location at which the first indenter forms the first indentation; and the second indenter is non-movable with respect to the fusing surface along the dimension.

4. The fuser of claim 1, wherein:

the first indenter is movable with respect to the fusing surface along a dimension of the fuser member to adjust the first location at which the first indenter forms the first indentation; and the second indenter is movable with respect to the fusing surface along the dimension to adjust the second location at which the second indenter forms the second indentation.

5. The fuser of claim 1, wherein the fuser member is a fuser belt comprising the fusing surface.

6. The fuser of claim 1, wherein the fuser member is a fuser roll comprising the fusing surface.

7. The fuser of claim 1, further comprising:

a pressure roll including an outer surface;

a nip between the fusing surface and the outer surface; and at least one heating element for heating the fusing surface;

wherein:

the first and second indentations overlap respective opposite edges of the medium, which define a dimension of the media, when the medium is at the nip; and the fuser member is rotatable in a counter-clockwise direction, the first and second indenters are positioned in a clockwise direction about the fusing surface from the nip, and the first and second indentations extend parallel to each other on the fusing surface and are rotated through the nip with the medium.

8. A printing apparatus comprising a fuser according to claim 1.

9. A method of fusing toner on a medium using the fuser according to claim 1, comprising:

forming the first indentation at the first location in the fusing surface with the first indenter during rotation of the fuser member;

forming the second indentation at the second location in the fusing surface with the second indenter during rotation of the fuser member; and feeding the medium to the nip where the medium contacts the fusing surface and the first and second indentations overlap opposed first and second edges, respectively, of the medium.

10. The method of claim 9, wherein:

the fuser member is a fuser roll and the fusing surface defines an outer circumference of the fuser roll; and the first and second indentations extend substantially parallel to each other about the outer circumference.

11. The method of claim 9, wherein the fuser member is a fuser belt.

12. A printing apparatus, comprising:

a first roll including a first outer surface;

a second roll including a second outer surface, a longitudinal axis and a length dimension along the longitudinal axis;

a nip between the first and second outer surfaces;

a first indenter adapted to form a first indentation at a first location in the second outer surface; and a second indenter adapted to form a second indentation in the second outer surface at a second location laterally spaced from the first location along the length dimension.

13. The printing apparatus of claim 12, wherein the first roll is a pressure roll and the second roll is a fuser roll.

14. The printing apparatus of claim 13, wherein:

the second outer surface is comprised of an elastomeric material which defines an outer circumference of the second roll;

the first indenter is a first indenter roll;

the second indenter is a second indenter roll; and the first and second indentations extend parallel to each other about the outer circumference of the fuser roll.

15. The printing apparatus of claim 12, wherein:

the printing apparatus is an ink jet printing apparatus;

the first roll is a pressure roll; and the second roll is a spreader roll.

16. The printing apparatus of claim 12, further comprising a fuser belt disposed between the first roll and the second roll.

17. The printing apparatus of claim 12, wherein the second outer surface is comprised of an elastomeric material.

18. The printing apparatus of claim 12, wherein:

the printing apparatus is an offset printing apparatus; and the second roll is a blanket roll.

19. The printing apparatus of claim 12, wherein:

the first indenter is movable with respect to the second outer surface along the length dimension to adjust the first location at which the first indenter forms the first indentation; and the second indenter is non-movable with respect to the second outer surface along the length dimension.

20. The printing apparatus of claim 12, wherein:

the first indenter roll is movable with respect to the second outer surface along the length dimension to adjust the first location at which the first indenter forms the first indentation; and the second indenter roll is movable with respect to the second outer surface along the length dimension to adjust the second location at which the second indenter forms the second indentation.

21. The printing apparatus of claim 12, further comprising:

a support;

a first spring connected to the support and the first indenter to resiliently bias the first indenter against the second outer surface at the first location; and a second spring connected to the support and the second indenter to resiliently bias the second indenter against the second outer surface at the second location;

wherein the support is movable to move the first and second indenters into contact and out of contact with the fusing surface.

22. A method of printing using a printing apparatus comprising a first roll including a first outer surface, a second roll including a second outer surface, a longitudinal axis and a length dimension along the longitudinal axis, and a nip between the first and second outer surfaces, the method comprising:

forming a first indentation at a first location in the second outer surface with a first indenter during rotation of the second roll;

forming a second indentation at a second location in the second outer surface, which is laterally spaced from the first location along the length dimension, with a second indenter during rotation of the second roll; and feeding the medium to the nip where the medium contacts the first and second outer surfaces and the first and second indentations overlap opposed first and second edges, respectively, of the medium.

23. The method of claim 22, wherein:

the first roll is a pressure roll;

the second roll is a fuser roll; and the first and second indentations extend parallel to each other about the outer circumference.

24. The method of claim 22, wherein:

the printing apparatus is an ink jet printing apparatus;

the first roll is a pressure roll; and the second roll is a spreader roll.

25. The method of claim 22, wherein the printing apparatus comprises a fuser belt disposed between the first roll and the second roll.

26. The method of claim 22, wherein:

the printing apparatus is an offset printing apparatus; and the second roll is a blanket roll.

* * * * *